US010772428B2

(12) United States Patent
Gregory et al.

(10) Patent No.: US 10,772,428 B2
(45) Date of Patent: Sep. 15, 2020

(54) THERAPY STOOL HAVING AN ADJUSTABLE HEIGHT AND A TILTABLE SEAT

(71) Applicant: Virco Mfg. Corporation, Torrance, CA (US)

(72) Inventors: John Gregory, Enola, AR (US); Jamie Toland, Pottsville, AR (US)

(73) Assignee: Virco Mfg. Corporation, Torrance, CA (US)

( * ) Notice: Subject to any disclaimer, the term of this patent is extended or adjusted under 35 U.S.C. 154(b) by 0 days.

(21) Appl. No.: 15/934,900

(22) Filed: Mar. 23, 2018

(65) Prior Publication Data

US 2018/0271289 A1 Sep. 27, 2018

Related U.S. Application Data

(60) Provisional application No. 62/477,345, filed on Mar. 27, 2017.

(51) Int. Cl.

| | |
|---|---|
| ***A47C 3/26*** | (2006.01) |
| ***A47C 3/026*** | (2006.01) |
| ***A47C 9/00*** | (2006.01) |
| ***A47C 3/24*** | (2006.01) |

(52) U.S. Cl.

CPC ..... *A47C 3/26* (2013.01); *A47C 3/026* (2013.01); *A47C 3/24* (2013.01); *A47C 9/002* (2013.01)

(58) Field of Classification Search

CPC .... A47C 3/20; A47C 3/24; A47C 3/40; A47C 3/26; A47C 3/026; A47C 9/002

See application file for complete search history.

(56) References Cited

U.S. PATENT DOCUMENTS

| | | | | |
|---|---|---|---|---|
| 9,060,612 | B2 * | 6/2015 | Lee | A47C 7/14 |
| 2006/0238008 | A1 * | 10/2006 | Baranov | A47C 3/24 297/338 |
| 2009/0188410 | A1 | 7/2009 | Frese | |
| 2010/0295350 | A1 * | 11/2010 | Barman | A47C 3/36 297/313 |
| 2013/0031712 | A1 * | 2/2013 | Gossett | A47C 3/34 4/496 |
| 2016/0038780 | A1 * | 2/2016 | Hugou | A47C 3/029 482/8 |

FOREIGN PATENT DOCUMENTS

| | | |
|---|---|---|
| EP | 0761136 | 11/2000 |

OTHER PUBLICATIONS

Office Action issued in Canadian application No. 2999312 dated Feb. 11, 2019.

* cited by examiner

*Primary Examiner* — Philip F Gabler
(74) *Attorney, Agent, or Firm* — Knobbe, Martens, Olson & Bear, LLP

(57) ABSTRACT

A stool comprises a height-adjustable seat. The seat is coupled to a stem of the stool using a ball and socket mechanism. The ball and socket mechanism enables the seat to be tiltable up to 20 degrees in all directions about a vertical axis. The ball and socket mechanism aids in providing the seated individual with an increased range of motion. The range of tiltable motion can be adjusted using an adjustment member.

20 Claims, 12 Drawing Sheets

THERAPY STOOL HAVING AN ADJUSTABLE HEIGHT AND A TILTABLE SEAT

RELATED APPLICATIONS

Any and all applications for which a foreign or domestic priority claim is identified in the Application Data Sheet as filed with the present application are incorporated by reference under 37 CFR 1.57 and made a part of this specification.

BACKGROUND

Field

The present disclosure generally relates to a therapy stool having a height-adjustable seat, wherein the seat is also tiltable to provide a range of motion.

Description of the Related Art

Balls, including yoga balls, are sometimes used for therapy purposes. Balls, when used for seating, provide the seated individual with a range of movement. However, when used as seats, balls lack the ability to be height adjusted. Further, balls fail to provide a flat sitting surface, which is important for therapy and core training. Finally, balls are unstable for seating purposes and are prone to rolling around when in use.

T-shaped stools or "T-stools" are also sometimes used for therapy purposes. T-stools provide the seated individual with a range of movement. Moreover, some T-stools are height-adjustable. Further, T-stools, unlike balls, have a flat sitting surface. However, T-stools, like balls, are unstable for seating purposes and are prone to falling over when in use.

A need therefore exists for a height-adjustable therapy chair or stool that provides the seated individual with a range of movement and a flat sitting surface, and that can be adjusted such that it can be stable for seating purposes.

SUMMARY OF CERTAIN EMBODIMENTS

Accordingly, a height-adjustable therapy stool has been developed that provides the seated individual with a range of movement and a flat sitting surface, and that has adjustable stability for seating purposes.

The methods and devices described herein have innovative aspects, no single one of which is indispensable or solely responsible for their desirable attributes. Without limiting the scope of the claims, some of the advantageous features will now be summarized.

In some embodiments, a stool comprises a seat component comprising a seat and a ball. The seat has a height. The ball has a diameter and is configured to depend from the seat. The ball is part of a ball and socket mechanism. The ball and socket mechanism enables the seat to be tiltable by a maximum degree of tiltability. A stem component comprises a tubular member. A socket of the ball and socket mechanism is located within an internal region of the tubular member. A height adjustment ring member engages with the tubular member. A stability adjustment ring member at least partially surrounds the tubular member. The tubular member has at least one threaded external region. The height adjustment ring member is configured to be attached to a region of the tubular member that is not threaded. Rotation of the height adjustment ring member adjusts the height of the seat.

The stability adjustment ring member is configured to be rotatably coupled to a region of the tubular member that is threaded. Rotation of the stability adjustment ring member adjusts the degree of tiltability of the seat. A base component comprises a pedestal. The pedestal has a threaded internal region configured to allow the tube to be rotatably coupled to the pedestal.

In some embodiments, the height of the seat is adjustable between 10 and 20 inches.

In some embodiments, the diameter of the ball is between 10 and 14 inches.

In some embodiments, the leveling feet can be used to level the stool relative to a ground surface.

In some embodiments, the leveling feet can be used to adjust the height of the seat.

In some embodiments, a stool has a seat that has an adjustable height and an adjustable degree of tilt. The stool comprises a base. The base includes an internally threaded bore. A central tubular member has a lower portion that is externally threaded. The externally threaded lower portion is received within the internally threaded bore of the base. A height adjustment member is connected to the central tubular member and is fixed against rotation about a vertical axis relative to the tube. An upper portion of the central tubular member is externally threaded. A tilt adjustment member has an internal thread and is rotatable relative to the externally threaded upper portion of the tube. The tilt adjustment member has a control surface configured to bear against a seat. The seat has a seating surface and a depending ball. The depending ball is captured within a socket defined within the central tubular member by at least one socket block and the ball and socket defines a coupling between the seat and the central tubular member that allows tilting of the seat relative to a vertical axis that extends through a center of the socket.

In some embodiments, rotation of the tilt adjustment member in a first direction advances the control surface toward the seat and rotation of the tilt adjustment member in a second direction.

In some embodiments, rotation of the central tubular member in a first direction increases a height of the seat and rotation of the central tubular member in a second direction decreases the height of the seat.

In some embodiments, an interaction of the ball and the socket define a maximum range of tiling of the seat relative to the vertical axis that extends through the center of the socket.

In some embodiments, the seat has a flat top surface.

In some embodiments, the tilt adjustment member has an upper surface that is configured to contact a bottom surface of the seat.

In some embodiments, the base comprises at least adjustable one mounting foot.

In some embodiments, the height adjustment member is secured to the central tubular member using a shaft that extends through at least a portion of both of the height adjustment member and the tube.

In some embodiments, the shaft also secures the at least one socket block in place within the central tubular member.

In some embodiments, an end of the shaft includes a toggle or a handle.

In some embodiments, a stool comprises a base and a seat with the seat being connected to the base via means for adjusting a seat tilt relative to the base and means for adjusting a height of the seat.

In some embodiments, the means for adjusting a seat tilt relative to the base comprises a ball and socket connection and an adjustment member that moves toward and away from the seat.

In some embodiments, the means for adjusting a height of the seat comprises an internally threaded socket defined within the base and a central tubular member having an externally threaded portion.

BRIEF DESCRIPTION OF THE DRAWINGS

Throughout the drawings, reference numbers have been reused to indicate general correspondence between reference elements. The drawings are provided to illustrate example embodiments described herein and are not intended to limit the scope of the disclosure.

DETAILED DESCRIPTION OF SOME EMBODIMENTS

FIGS. 1-4 show various views of a stool 100 that is arranged and configured in accordance with certain features, aspects and advantages of the present disclosure. In the illustrated embodiment, the stool 100 comprises three main components: a seat component 102, a stem component 104, and a base component 106. The stem component 104 connects the seat component 102 to the base component 106. As used herein, the term "component" is intended to encompass groups of elements that together define a functional module. FIGS. 10-17 show various views of another stool 100 that also is arranged and configured in accordance with certain features, aspects, and advantages of the present disclosure. As will be described, the embodiment of FIGS. 5-12 differs from the embodiment of FIGS. 1-4 mainly in the structures used to manipulate a height of the seat and to adjust a maximum tilt angle of the seat. Desirably, at least two of the three main components can be easily separated from each other for transportation and/or cleaning, for example. In some configurations, the three main components can be easily separated from each other for transportation and/or cleaning, for example. In the illustrated configurations, the seat component 102 can be quickly and simply removed from the stem component 102 for transportation and/or cleaning, for example.

Figure 1:
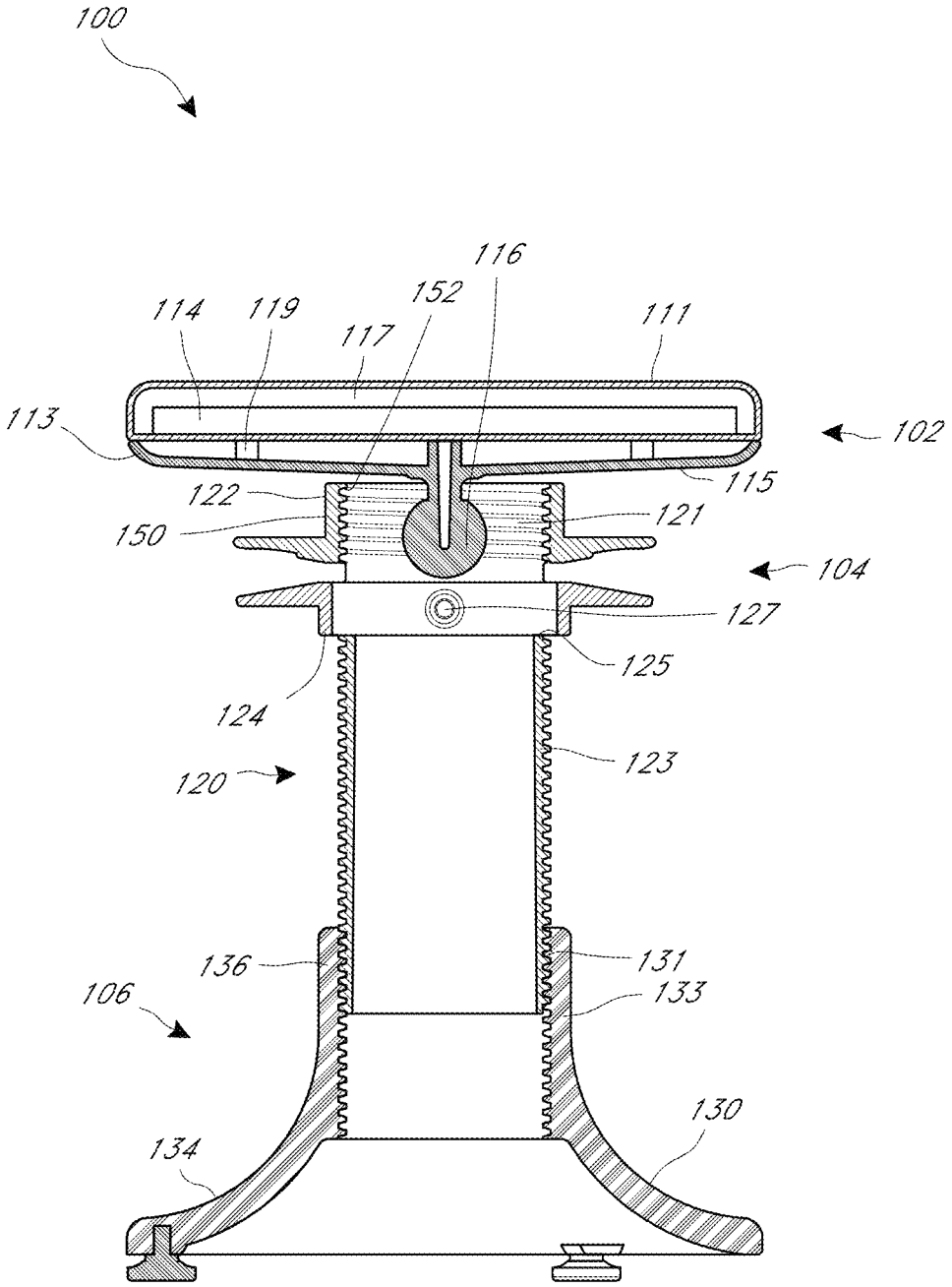
FIG. 1 is a side sectioned view of a stool having a limitable range of motion and an adjustable height that is arranged and configured in accordance with certain features, aspects, and advantages of the present disclosure.

With reference to now to FIGS. 1 through 4, the seat component 102 generally comprises a seat 110 and a mounting ball 116. The illustrated seat 110 has a generally flat sitting surface 112. In the illustrated configuration, the sitting surface is generally circular. In some configurations, the sitting surface 112 is generally circular with a diameter of 12 inches. However, other suitable diameters are possible keeping in mind a desire to support the ischial tuberosity of a population up to about 14 years of age. Desirably, the sitting surface 112 is large enough to accommodate the ischial tuberosity of children up to the age of about 14 years but not significantly larger. For example, the diameter of the sitting surface 112 can be between 10 inches to 14 inches. Moreover, although the sitting surface 112 is generally flat, in some embodiments, the sitting surface 112 may have a slight curvature. For example, the sitting surface 112 may be slightly concave or convex depending on the material used. The sitting surface 112 preferably is padded. Any suitable sitting surface can be used. In some configurations, the sitting surface is positioned atop a seat frame 113. The seat frame 113 can be formed of any suitable, preferably rigid, material. In some configurations, the seat frame 113 is formed of a suitable plastic material. As shown in FIG. 1, for example, in some configurations, a base material 114 supports a cushion 117 that is covered by an outer covering 118. The cushion 117 can be any suitable material and, in some configurations, is a foam pad. The base material 114, which can be a material such as plywood or another laminate product, can be secured to the seat frame 113 in any suitable manner. For example, in some configurations, the base material is secured to the seat frame 113 using threaded fasteners 119.

With reference again to FIG. 1, the stem component 104 comprises a tubular component 120. The tubular component 120 in the illustrated configuration is at least partially threaded. That is, the illustrated tubular component 120 comprises an external, male screw thread pattern along segments of its external surface. In the illustrated configuration, as shown in FIG. 1, the tubular component 120 comprises an upper threaded portion 121 and a lower threaded portion 123 that are separated by an unthreaded portion 125. In some configurations, the upper threaded portion 121 and the lower threaded portion 123 have the same type of threading. In some configurations, the upper threaded portion 121 and the lower threaded portion 123 have opposing hands of threading. In some configurations, the upper threaded portion 121 has a shorter axial length than the lower threaded portion 123. In some configurations, the upper threaded portion 121 and the lower threaded portion 123 have the same length. In some configurations, the entire tubular member 120 can be threaded and the unthreaded portion 125 is omitted. In some configurations, only one threaded region is provided. Other configurations are possible.

As illustrated, the stem component 104 also comprises a stability adjustment member 122 and a height adjustment member 124. The members 122, 124 facilitate adjustment of the seat component 102 in desired ways. While the members 122, 124 are illustrated as two ring members in FIGS. 1-4, it is possible to use handles, levers, posts, pegs, handgrips, or the like in addition to or as an alternative to the members 122, 124. For example, as shown in FIG. 5, the stability adjustment member 122 can comprise a collar 138 with one or more levers 140 extending generally radially outward. In the illustrated configuration, the collar 138 and the levers 140 are integrally formed. In other configurations, the levers 140 can be formed separate of the collar 138 and connected or secured to the collar 138 in any suitable manner. As also shown in FIG. 5, the height adjustment member 124 comprises one or more handles 142 that extend radially outward relative to the tubular component 120. Thus, in some configurations, one ring shaped member 122 and one other type of member 124 can be used in some configurations.

Figure 12:
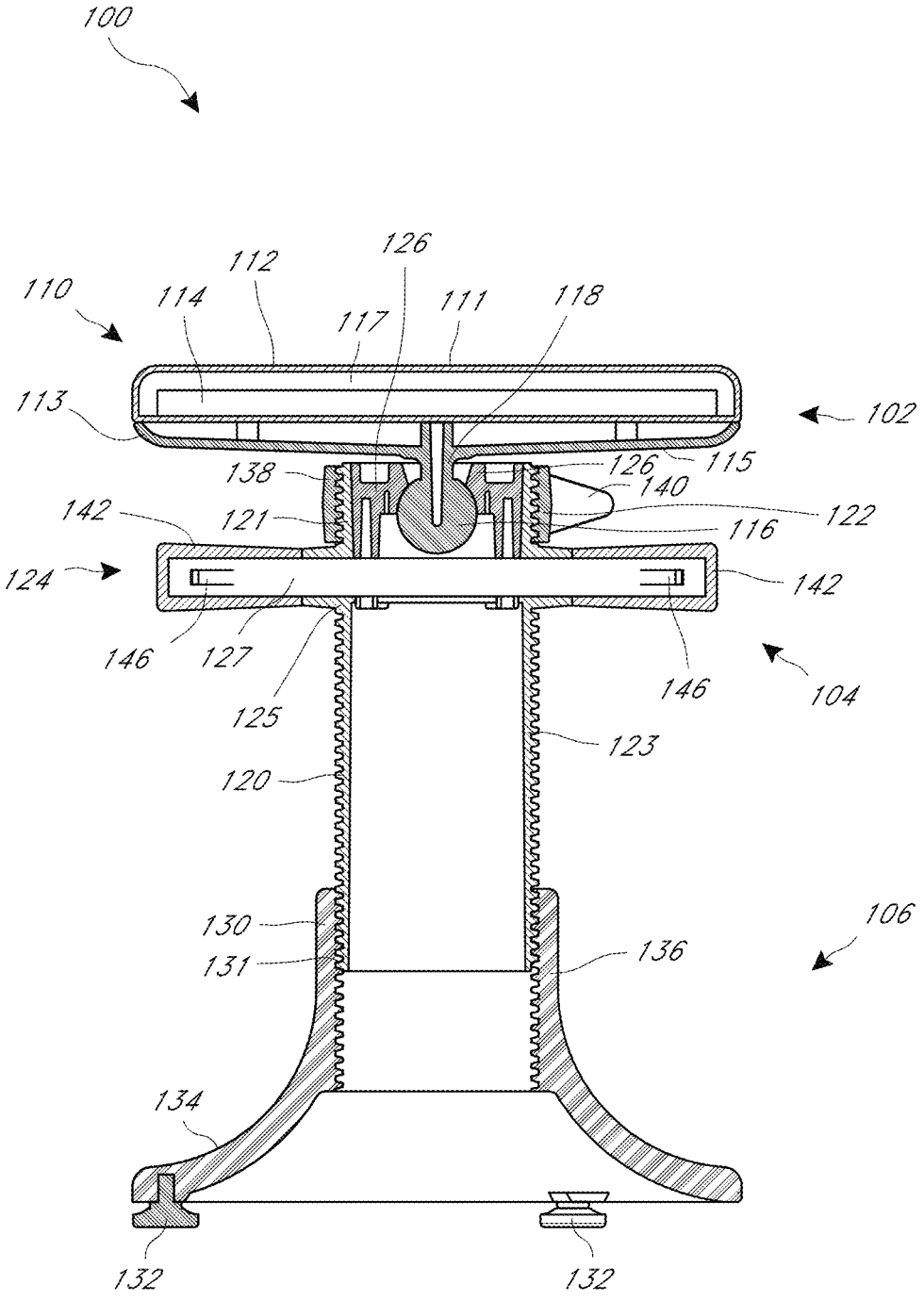
FIG. 12 is a sectioned view taken along the line 12-12 in FIG. 10.

With reference again to FIG. 3, the height adjustment member 124 can be attached or joined to a segment of the external surface of the tubular component 120. In the illustrated configuration, the height adjustment member 124 is secured to the unthreaded portion 125. The height adjustment member 124 can adjust at least a portion of the stem component 104 relative to the base component 106. In the illustrated configuration, the height adjustment member 124 is used to rotate the tubular member 120 relative to the base component 106. As such, the height adjustment member 124 is fixed against rotation relative to the tubular member 120. With reference to FIG. 5 and FIG. 12, a shaft 127 can extend through a matching set of bores that are formed in the height adjustment member 124 and the tubular member 120. The illustrated shaft 127 includes a handle end 129 and a toggle 131 that reduces the likelihood of the shaft 127 becoming dislodged during use. Other suitable assemblies, techniques or components also can be used to secure the height adjustment member or member 124 against significant rotation relative to the tubular member 120. Moreover, as shown in FIG. 5 and FIG. 12, the shaft 127 extends through the tubular member 120 and carries one or more handles 142, which can serve as the height adjustment member 124. In particular, the shaft 127 extends through the tubular member 120 and, therefore, is fixed to the tubular member 120 such that the shaft 127 can be used to cause rotational movement of the tubular member 120 about a center axis of the tubular member 120. To improve aesthetics, to provide a more comfortable grip, and to reduce the likelihood of the shaft 127 disengaging from the tubular member 120, the illustrated configuration features one handle 142 at each end of the shaft 127. The handles 142 have a larger cross section relative to the shaft 127. One or more of the handles 142 is designed to be removable from the shaft 127. In the illustrated configuration, pop-pins are used to removably connect the handles 142 to the shaft 127. In other words, the shaft has an opening that receives a spring biased pin 143. The spring biased pin 143 is biased to project from the opening by a leaf spring 146 or the like. The pin 143 extends through a corresponding hole in the handle 142 to secure the handle against inadvertent disconnection from the shaft 127. In some configurations, the handles 142 comprise a recessed region 148 surrounding the hole that receives the pin 143. Other coupling arrangements also can be used.

Figure 4:
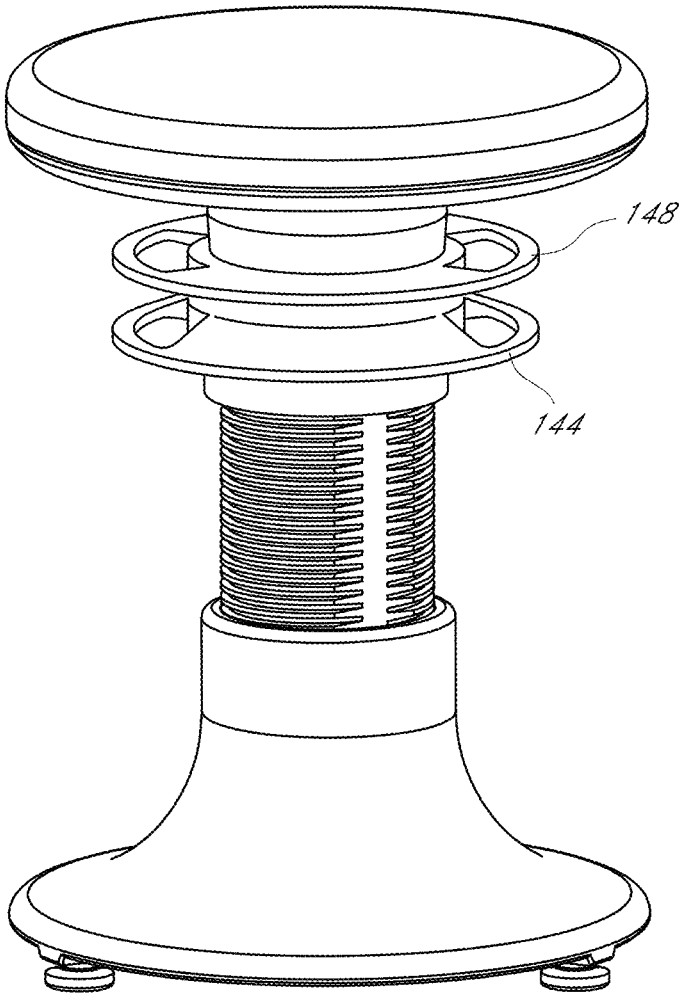
FIG. 4 is a side perspective view of the stool of FIG. 1.
Figure 5:
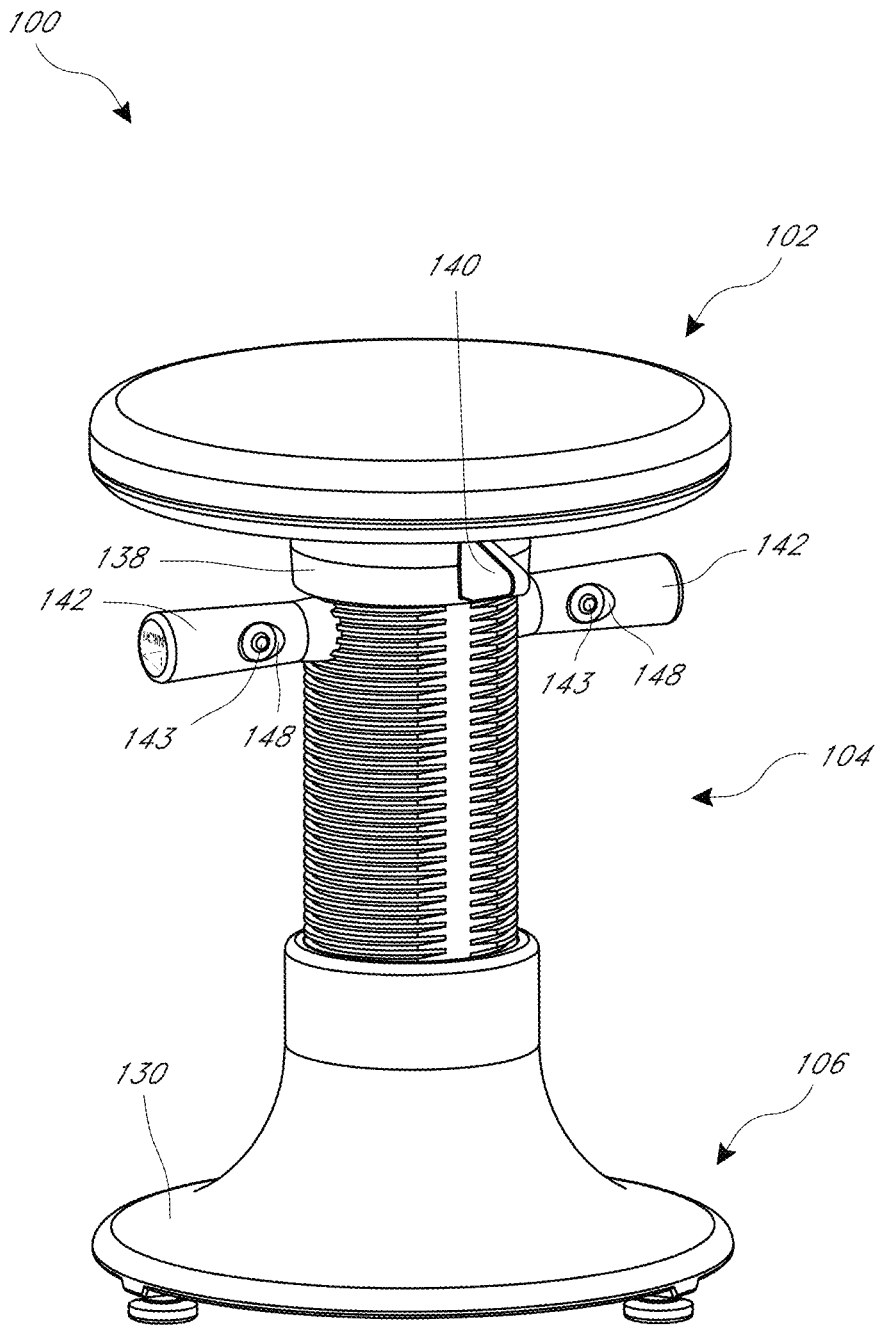
FIG. 5 is a perspective view of another stool that is arranged and configured in accordance with certain features, aspects, and advantages of the present disclosure.
Figure 6:
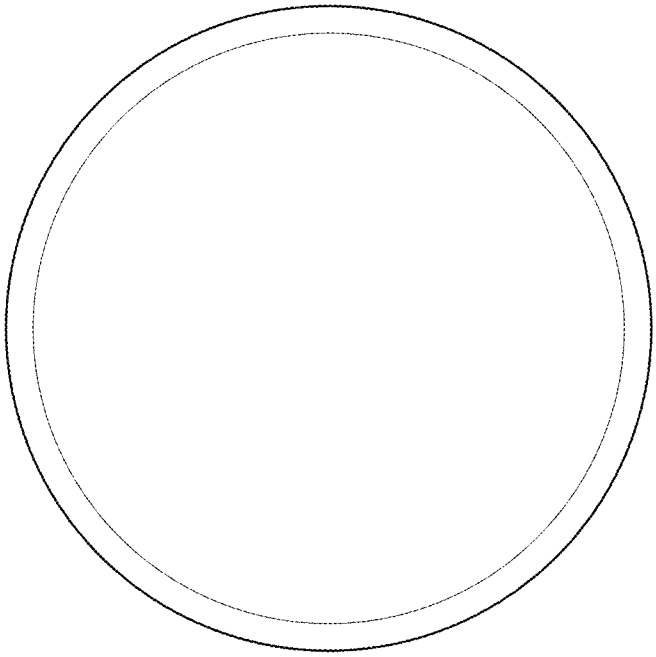
FIG. 6 is a top view of the stool of FIG. 5.
Figure 7:
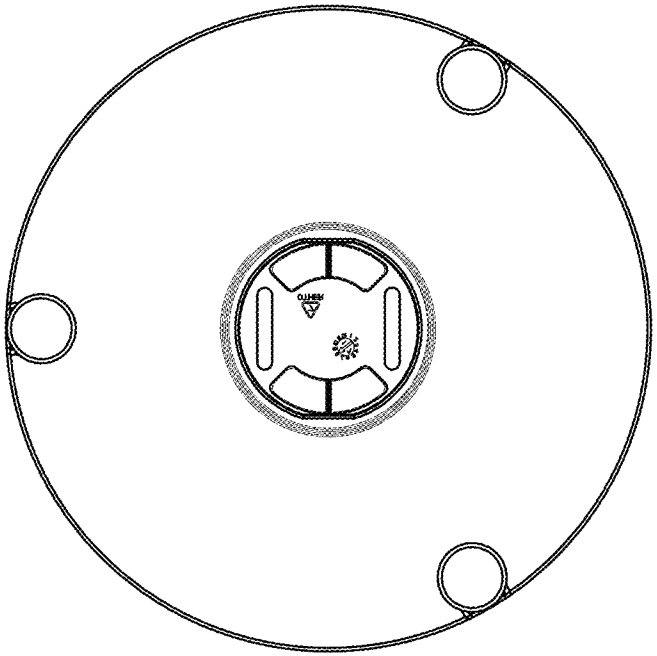
FIG. 7 is a bottom view of the stool of FIG. 5.
Figure 8:
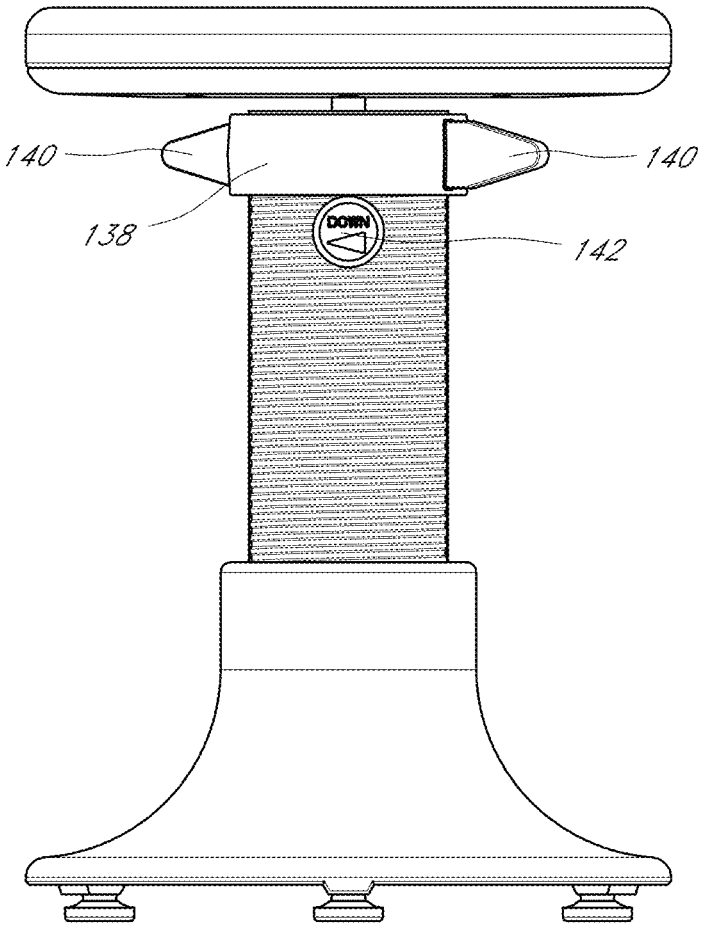
FIG. 8 is a right elevation view of the stool of FIG. 5.
Figure 9:
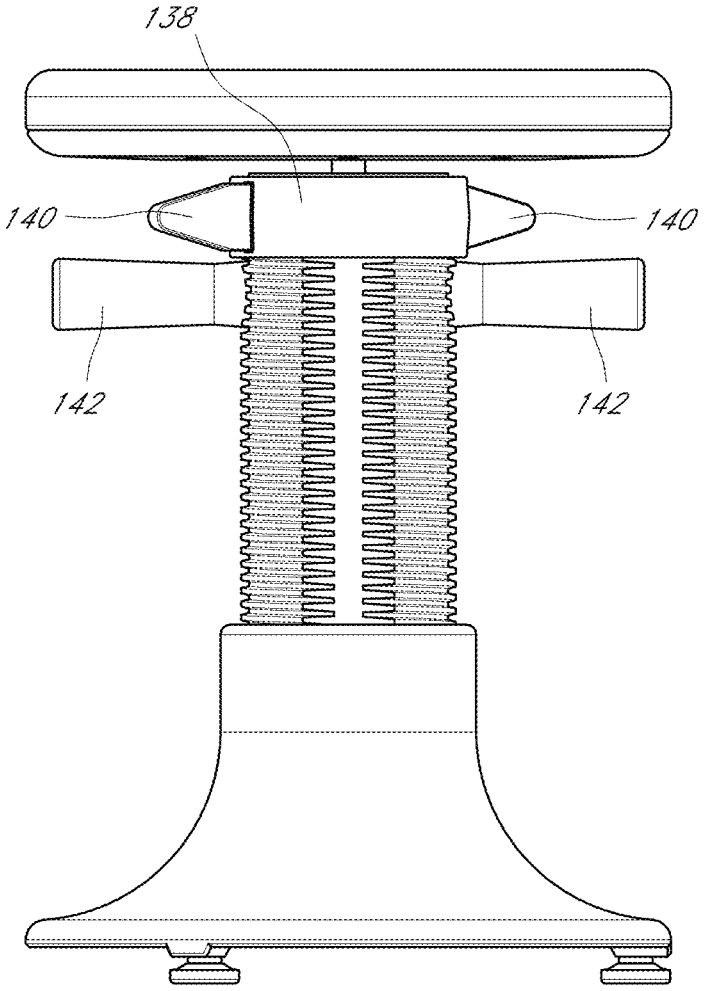
FIG. 9 is a front elevation view of the stool of FIG. 5.
Figure 10:
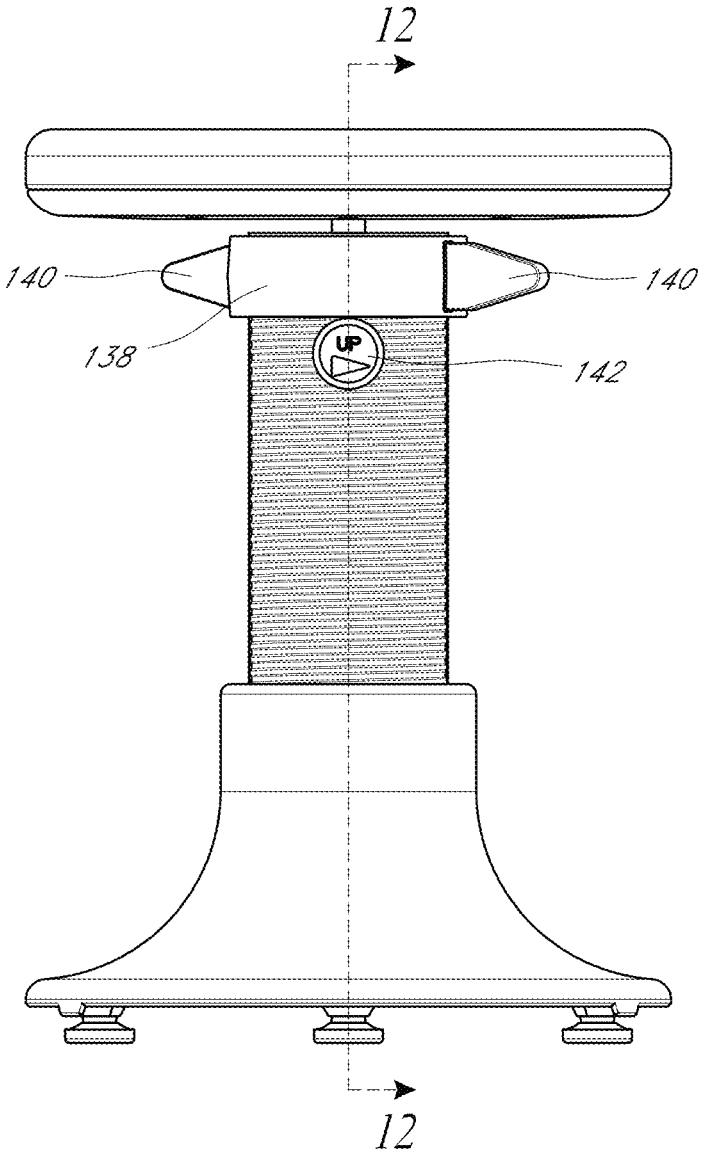
FIG. 10 is a left elevation view of the stool of FIG. 5.
Figure 11:
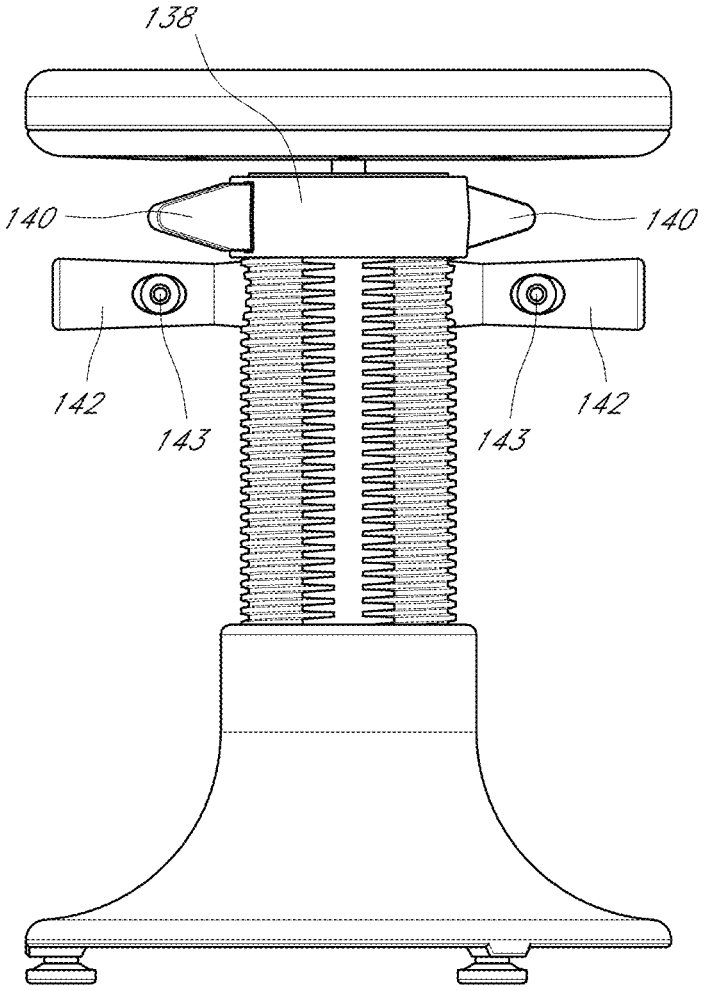
FIG. 11 is a rear elevation view of the stool of FIG. 5.

With to reference to FIG. 1 and FIG. 4, at least a portion of a pedestal 130 of the base component 106 comprises an internal bore 133. The internal bore 133 can comprise a female screw thread pattern 131. The female screw thread pattern 131 meshes with the male thread of the lower threaded portion 131. The meshing of the threads allows the tubular member 120 of the stem component 104 to be translated relative to the pedestal 130 when the tubular member 120 is rotated relative to the pedestal 130. The height adjustment member 124, which is attached or joined to the tubular member 120, facilitates rotation of the tubular member 120 relative to the pedestal 130. That is, the height adjustment member 124 of FIGS. 1-4 has a handle grip region 144 (see FIG. 4) that enables the member 124 and, hence, the tubular member 120 to be manually rotated by human force. The height of the seat 110 can be adjusted using the height adjustment member 124. The height of the seat 110 is measured from a ground surface to a center point of the sitting surface 112 of the seat 110. In the illustrated embodiment, rotation of the height adjustment member 124 adjusts the height of the seat 110 by causing axial movement of the tubular member 120 relative to the pedestal 130.

In the illustrated embodiment, the seat 110 has a height that is adjustable between 14 and 18 inches. However, other suitable height ranges are possible. For example, the height of the seat 110 can be between 12 and 20 inches. A suitable height is one in which the seated individual's leg angle (i.e., the bend at the knee) is at approximately 90 degrees with the individual's feet flat on the floor while seated. However, other leg angles may be appropriate depending on the particular needs of the seated individual.

The stability adjustment member 122 is coupled to a segment of the external surface of the tubular member 120 that is threaded. In the illustrated configuration, the stability adjustment member 122 is coupled with the upper threaded portion 121. The stability adjustment member 122 is capable of rotating relative to the tubular member 120. In particular, the stability adjustment member 122 includes an axially extending portion 150. The axially extending portion 150 includes an internally threaded surface 152. The internally threaded surface 152 meshes with the upper threaded portion 121 of the tubular member 120. Rotation of the stability adjustment member 122 results in axial translation of the stability adjustment member 122 along the tubular member 120.

To facilitate rotation of the stability adjustment member 122, the stability adjustment member 122 can include one or more handle regions 148 (see FIG. 4). In the illustrated configuration, the one or more handle regions 142 extend from the axially extending portion 150. In some configurations, the handle region 148 comprises four holes. That is, the handle region 148 of the stability adjustment member 122 has four holes. The holes aid in gripping and rotating the member 122. In other embodiments, however, the handle region 148 can each comprise less than or more than four holes. Moreover, instead of providing holes in the handle region 148, other configurations can be provided to aid in gripping and rotating the member 122. For example, as shown in FIGS. 5-12, the handle region 148 can take the form of one or more levers 140. The levers 140, as discussed above, can project radially outward from the collar 138 of the stability adjustment member 122.

When translated upwardly, the stability adjustment member 122 is configured to make contact with at least a portion of a lower surface 115 of the seat component 102. The closer the stability adjustment member 122 comes to the lower surface 115 of the seat component 102, the less freedom of movement is afforded to the seat component 102. When fully seated against the lower surface 115 of the seat component 102, the adjustment member 122 prevents any significant movement of the seat component 102. Thus, axial movement of the stability adjustment member 122 relative to the seat component 102 alters the amount of movement afforded to the seat component. While the stability adjustment member 122 is illustrated as a ring, other components can be used keeping in mind a desire to have a portion of the stability adjustment member or ring 122 contact at least a portion of the seat component 102 to reduce the range of motion relative to the tubular member 120.

Moreover, in the illustrated configuration, when the stability adjustment member 122 is in contact with the lower surface 115 of the seat component 102, the stability adjustment member 122 has at least a portion remaining engaged with the upper threaded portion 121 of the tubular member 120 and at least a portion that is no longer in contact with the tubular member 120 (i.e., the stability adjustment member 120 is only partially engaged with the tubular member 120).

In some configurations, when the stability adjustment member 122 is fully engaged with the seat component, about ½ inch to ⅝ inch of the stability adjustment member 122 remains engaged with the tubular member 120. In some configurations, the portion of the stability adjustment member 122 that remains engaged with the tubular member 120 is between ⅜ inch and 1 inch. Other configurations are possible. In some configurations, the travel of the stability adjustment member 122 is limited at the upper end by the lower surface of the seat 115 and at the lower end by the shaft 127. Other configurations also can be used to limit the range of movement of the stability adjustment member.

Because the degree of tilt capable by the seat component 102 can be adjusted by the stability adjustment member 122, it is possible to provide a graduated scale or other reference markings that can be used to record the position of the stability adjustment member relative to the seat. In some configurations, the graduated scale is a vertical scale. In some configurations, the graduated scale is a rotational scale. Any suitable technique can be used.

With reference still to FIG. 1, the pedestal 130 has an enlarged lower region 134 and a region 136 of generally constant diameter. As discussed above, the pedestal 130 has an internally threaded bore, which comprises the female screw thread pattern 131 configured to allow the tubular member 120 to be coupled to the pedestal 130 while having the tubular member 120 being capable of rotation to induce axial travel. In the illustrated embodiment, a majority of the female screw thread pattern 131 is disposed within the region 136. In the illustrated embodiment, the female screw tread pattern 131 also extends into the enlarged lower region 134. Other configurations also are possible.

The larger diameter lower region 134 can be larger in diameter (or have one or more diameters that are larger in diameter) than the upper region 136, which has a relatively constant diameter. The larger lower region 134 enhances stability of the stool 100. In some configurations, the lowermost portion of the lower region 134 has the largest diameter of the pedestal 130. The diameter of the pedestal desirably accomplishes two main goals: large enough to enhance stability and small enough to allow the user's feet to sit flat on the floor while the knees are bent at a 90 degree angle and the sitting bones are positioned squarely on the seat. Other configurations, including those having recess or cutouts, also can be used to accomplish these goals. Moreover, in some configurations, a foot accommodating region can be integrated into the stool 100. In the illustrated configuration, the largest diameter of the lower half of the pedestal 130 is between 6 inches and 20 inches. In some configurations, the largest diameter of the lower half of the pedestal is between 10 inches and 18 inches. In some configurations, the largest diameter of the largest diameter of the lower half of the pedestal is 14 inches.

Figure 2:
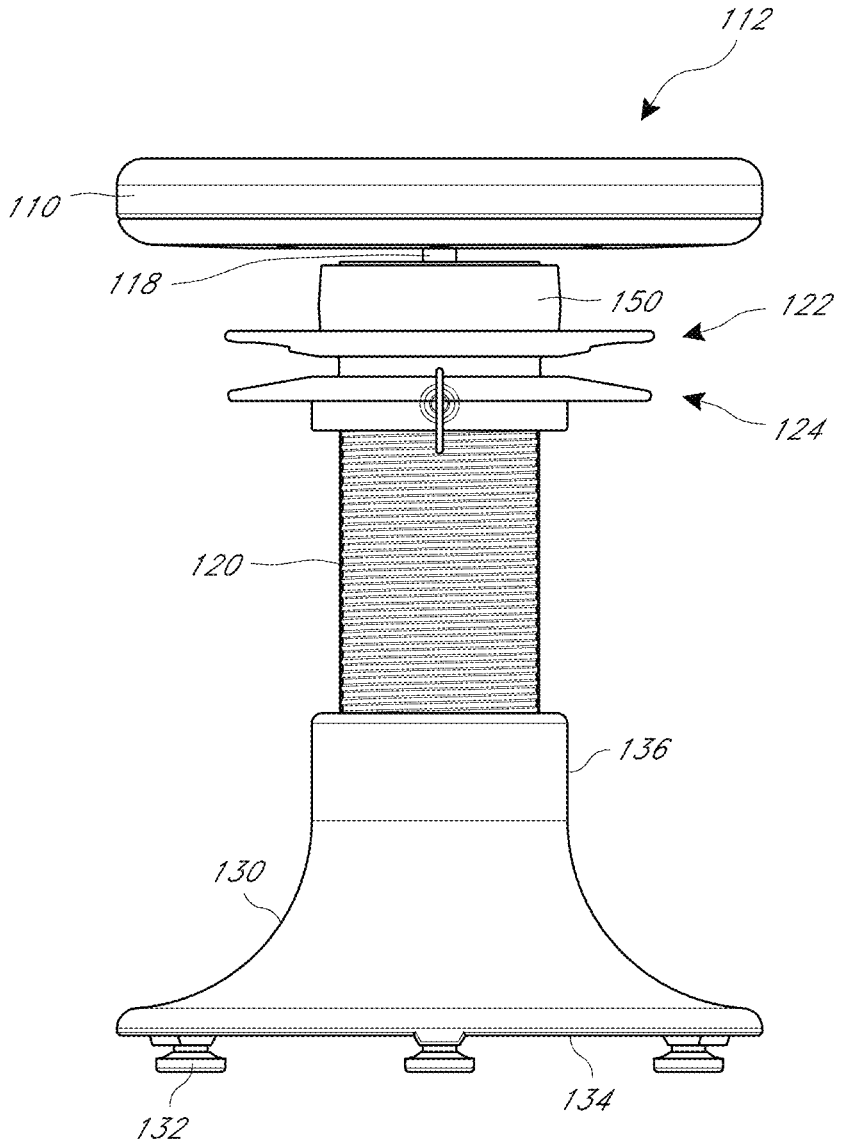
FIG. 2 is another side view of the stool of FIG. 1.
Figure 3:
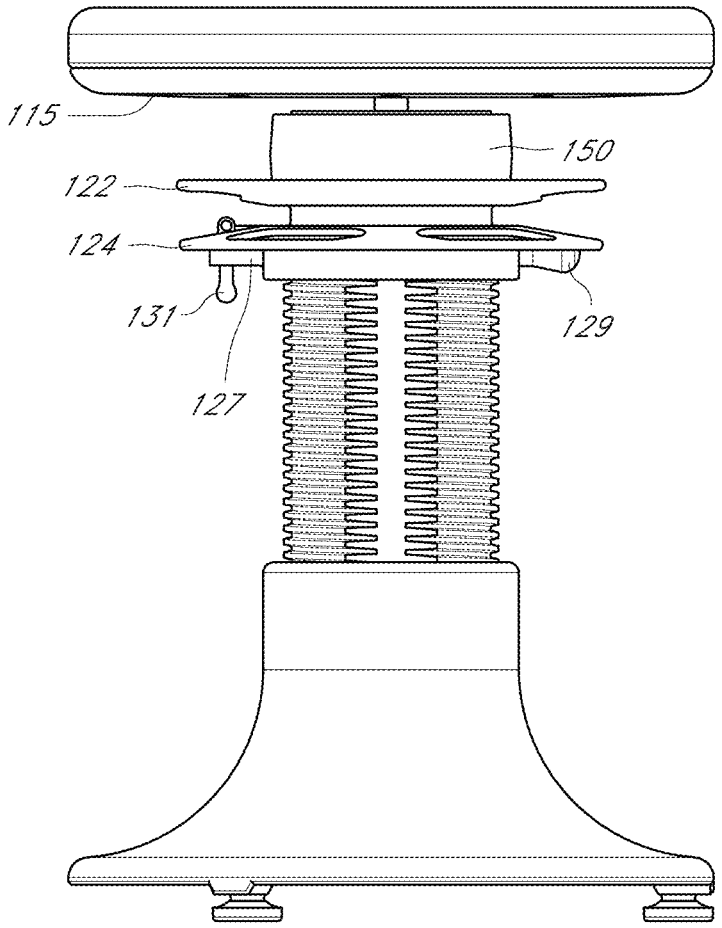
FIG. 3 is another side view of the stool of FIG. 1.

With reference to FIGS. 1 and 2, one or more leveling feet 132 of the base component 106 are rotatably connected to a bottom surface of the enlarged lower region 134 of the pedestal 130. The leveling feet 132 can be used to level the stool 100 relative to the ground. The leveling feet 132 can also be used to make minor adjustments to the height of the seat 110 relative to the ground. Although not shown, in some embodiments, the bottom surface of the leveling feet 132 can have grips to help reduce the likelihood of slippage of the stool 100 relative to the ground surface when the stool 100 is in use.

With reference to FIG. 12, the seat 110 of the seat component 102 and the tubular member 120 of the stem component 104 are coupled via a ball and socket mechanism. As discussed above, the ball 116 of the ball and socket mechanism is attached or joined to the bottom surface 115 of the seat 110. In the illustrated configuration, a neck-like connector 118 connects the ball 116 to the seat 110

The connector 118 can be attached to the seat in any desired manner. In some configurations, the connector 118 is connected with a threaded connection such that the connector can be removed from at least one of the ball 116 and the seat 110. In some configurations, the connector 118 can be integrally formed (i.e., formed as a single component, such as through molding) with at least one of the ball 116 and the seat 110. In some configurations, at least a portion of the seat 110 can be integrally formed with the ball 116 and the connector 118.

The connector 118 suspends the ball from the bottom of the seat 110. The connector 118 can have any suitable size. In some configurations, the connector 118 is sized in relation to the ball 116. The distance from the center of the ball 116 to a lower surface 115 of the seat 110 desirably is as small as possible. In some configurations, the distance is 2½ inches. In some configurations, the distance is between bout 0 and 5 inches. In some configurations, the connector 118 spaces the ball 116 away from the bottom surface 115 of the seat 110 a distance that places the ball 116 within the upper half of the tubular member 120. In some configurations, the connector 118 spaces the ball away from the bottom of the seat 110 a distance that places the ball 116 within the upper quarter of the tubular member 120. In some configurations, the ball 116 is mounted directly to the bottom of the seat 110. Placing the ball 116 as close to the seat as possible has been discovered to provide improved tilt performance for the stool 100.

The socket 119 of the ball and socket mechanism is configured to be located within an upper internal region of the tubular member 120. In some configurations, a lower portion of the socket is integrally formed within the tubular member 120. In some configurations, the lower portion of the socket is formed separate from the tubular member 120 and secured in place within the tubular member 120. The upper portion of the socket can be defined by two or more blocks 126 that at least partially surround the upper portion of the ball 116. Using two or more blocks 126 is advantageous when the ball 116 (and/or the mounting connector 118) is integrally formed with at least a portion of the seat 110. In some configurations, a single block 126 can be used when the ball 116 (and/or the connector 118) is removable from the seat 110. In some configurations, the two or more blocks can be secured together such that they define a single block once secured together.

In some configurations, the blocks 126 can be secured in position within the tubular member 120 by the shaft 127. In other words, the blocks 126 can include openings through which the shaft 127 can extend. In this manner, the blocks 126 are secured within the end of the tubular member 120 against axial movement along the tubular member 120 so long as the shaft 127 is inserted through the tubular member 120. The blocks 126, as illustrated in FIG. 12, need not completely enclose the perimeter of the ball 116 yet surround a sufficient portion of the ball 116 to secure the ball 116 against misplacement from the socket 119 during use.

The ball and socket mechanism enables the seat 110 to be tiltable by up to 20 degrees in all directions about a vertical axis. Preferably, the ball and socket mechanism enables the seat 110 to be tiltable up to 15 degrees in all directions about a vertical axis. In some configurations, the degree of tilting provided to the seat 110 is limited by the connector 118 contacting the blocks 126. In such configurations, the inner surface closest to the connector 118 are angled and the connector 118 contacts the inner surface of the blocks. In some configurations, the inner surface is conical or frusto-conical in configuration. Enabling the seat 110 to be tiltable aids in providing the seated individual with an increased range of motion.

As described above, the degree of tilt below the maximum angle can be adjusted using the stability adjustment member 122. In the illustrated embodiment, rotation of the stability adjustment member 122 in a first direction acts to reduce the degree to which the seat 110 can be tilted while rotation of the stability adjustment member 122 in a second direction acts to increase the degree to which the seat 110 can be tilted up to the maximum angle.

In the illustrated embodiment, the ball 116 has an approximately 1½ inch diameter. However, other suitable diameters are possible. For example, the diameter of the ball 116 can be between ¾ and 5 inches. One of ordinary skill in the art would understand that if the diameter of the ball 116 is too small, the seat 110 will be unstable. That is, the seat 110 will tilt with even the slightest movement of the seated individual. On the other hand, one of ordinary skill in the art would understand that if the diameter of the ball 116 is too large, the seat 110 will have limited tiltability. In other words, the degree of friction created between the ball and the socket increases with the increasing size of the ball.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include these features, elements and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise," "comprising," and the like, are to be construed in an inclusive sense as opposed to an exclusive or exhaustive sense, that is to say, in the sense of "including, but not limited to."

Reference to any prior art in this description is not, and should not be taken as, an acknowledgement or any form of suggestion that that prior art forms part of the common general knowledge in the field of endeavor in any country in the world.

The aspects of the invention may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the present disclosure and without diminishing its attendant advantages. For instance, various components may be repositioned as desired. It is therefore intended that such changes and modifications be included within the scope of the present disclosure. Moreover, not all of the features, aspects and advantages are necessarily required to practice the present disclosure. Accordingly, the scope of the present disclosure is intended to be defined only by the claims.

What is claimed is:

1. A stool comprising:

a seat component comprising:

a seat;

a connector coupled to the seat and extending from a bottom surface of the seat; and a ball coupled to the connector at a defined distance, the ball is part of a ball and socket mechanism, the ball and socket mechanism enabling the seat to be tiltable by a degree of tiltability; and a stem component comprising:

a tubular member having an internal region and at least one threaded external region;

a socket for the ball and socket mechanism, the socket defined by one or more blocks positioned within the internal region of the tubular member, the socket being located within an upper portion of the internal region of the tubular member and partially surrounding an upper portion of the ball, wherein the connector moves relative to the one or more blocks, and wherein the one or more blocks limit tiltability of the seat to a first degree of tiltability;

a height adjustment member comprising a shaft extending through and fixed to the tubular member, the shaft extending through the one or more blocks of the socket such that the shaft secures the one or more blocks in position within the tubular member against axial movement along the tubular member; and a stability adjustment member at least partially surrounding the tubular member, the stability adjustment member configured to be rotatably coupled to the at least one threaded external region of the tubular member, wherein rotation of the stability adjustment member adjusts a vertical position of the stability adjustment member relative to the seat to adjust the degree of tiltability of the seat to a second degree of tiltability, wherein the second degree of tiltability is less than or equal to the first degree of tiltability; and a base component comprising a pedestal, the pedestal having a threaded internal region configured to allow the tubular member to be rotatably coupled to the pedestal, wherein rotation of the height adjustment member rotates the tubular member relative to the base component and adjusts a height of the seat.

2. The stool of claim 1, wherein the height of the seat is adjustable between 10 and 20 inches.

3. The stool of claim 1, wherein a diameter of the ball is between 0.75 and 5 inches.

4. The stool of claim 1, wherein the pedestal comprises one or more leveling foot, and wherein the one or more leveling foot can be used to level the base component relative to a ground surface.

5. The stool of claim 4, wherein the one or more leveling foot can be used to adjust the height of the seat.

6. A stool comprising:

a seat that has an adjustable height and an adjustable degree of tilt, the seat comprising a seating surface and a ball extending from a bottom surface of the seat at a defined distance;

a base comprising an internally threaded bore;

a central tubular member comprising an externally threaded lower portion being received within the internally threaded bore of the base, an externally threaded upper portion, and an internal region;

a height adjustment member comprising a shaft extending through and fixed to the central tubular member;

a tilt adjustment member having an internal thread and being rotatable relative to the externally threaded upper portion of the central tubular member, the tilt adjustment member having a control surface configured to bear against the bottom surface of the seat and limit the degree of tilt of the seat; and a socket located within the internal region of the central tubular member formed by at least one socket block, the socket configured to receive the ball and allow the ball to rotate, thereby allowing tilting of the seat about a vertical axis defined by the central tubular member, the shaft of the height adjustment member extending through the at least one socket block of the socket such that the shaft secures the at least one socket block in position within the central tubular member.

7. The stool of claim 6, wherein rotation of the tilt adjustment member in a first direction advances the control surface toward the seat and rotation of the tilt adjustment member in a second direction advances the control surface away from the seat.

8. The stool of claim 6, wherein rotation of the central tubular member in a first direction increases a height of the seat and rotation of the central tubular member in a second direction decreases the height of the seat.

9. The stool of claim 8, wherein the seat further comprises a connector coupled to the ball, wherein the connector and the at least one socket block define a maximum range of tiling of the seat.

10. The stool of claim 6, wherein the seat has a flat top surface.

11. The stool of claim 6, wherein the control surface is configured to contact the bottom surface of the seat.

12. The stool of claim 6, wherein the base comprises at least one adjustable mounting foot.

13. The stool of claim 6, wherein the height adjustment member is secured to the central tubular member via the shaft.

14. The stool of claim 13, wherein the shaft secures the at least one socket block against axial movement along the central tubular member.

15. The stool of claim 14, wherein an end of the shaft includes a toggle or a handle.

16. A stool comprising:

a base;

a seat;

a ball and socket mechanism, a ball of the ball and socket mechanism coupled to the seat via a connector, a socket of the ball and socket mechanism positioned within a vertical tubular member of the stool, the socket defined by one or more blocks configured to limit tiltability of the seat by contacting the connector when the seat is tilted at a first angle, wherein the seat is connected to the base via the ball and socket mechanism;

a stability adjustment member configured to move toward or away from the seat, the stability adjustment member comprising a control surface configured to contact a bottom surface of the seat to limit the tiltability of the seat; and a height adjustment member comprising a shaft extending through and fixed to the vertical tubular member, the shaft extending through the one or more blocks of the socket to secure the socket in position within the vertical tubular member.

17. The stool of claim 16, wherein the first angle defines a maximum range of tilt for the seat.

18. The stool of claim 16, wherein the shaft secures the socket against axial movement along the vertical tubular member.

19. The stool of claim 16, wherein rotation of the height adjustment member rotates the vertical tubular member relative to the base and adjusts a height of the seat.

20. The stool of claim 16, wherein the movement of the stability adjustment member towards the seat reduces the tiltability of the seat, and wherein the movement of the stability adjustment member away from the seat increases the tiltability of the seat.

* * * * *